US005884633A

United States Patent [19]

Ford

[11] Patent Number: 5,884,633

[45] Date of Patent: Mar. 23, 1999

[54] COMBINATION COMB, BRUSH, AND TEASER APPARATUS

[76] Inventor: Judit Ford, 12406 El Oro Way, Granada Hills, Calif. 91344

[21] Appl. No.: 832,918

[22] Filed: Apr. 4, 1997

Related U.S. Application Data

[63] Continuation of Ser. No. 63,761, Dec. 2, 1996.

[51] Int. Cl.[6] ..... A45D 24/10

[52] U.S. Cl. ..... 132/137; 132/139; 132/149

[58] Field of Search ..... 132/137, 139, 132/140, 142, 126, 149, 150

[56] References Cited

U.S. PATENT DOCUMENTS

| | | | |
|---|---|---|---|
| 1,012,179 | 12/1911 | Weaver | 132/142 |
| 1,615,408 | 1/1927 | Scott | 132/126 |
| 1,711,486 | 5/1929 | Bushman | 132/142 |
| 1,780,206 | 11/1930 | McKellar | 132/137 |
| 1,950,667 | 3/1934 | Fulton | 132/142 |
| 1,994,505 | 3/1935 | Dove | 132/137 |
| 2,216,355 | 10/1940 | Pollock | 132/142 |
| 2,609,822 | 9/1952 | McCormack et al. | 123/126 |
| 2,661,007 | 12/1953 | Bauer | 132/142 |
| 3,324,865 | 6/1967 | Battaglia | 132/126 |
| 3,444,866 | 5/1969 | Battaglia | 132/126 |
| 4,513,842 | 4/1985 | Karlsberg | 132/149 |

FOREIGN PATENT DOCUMENTS

| | | | |
|---|---|---|---|
| 987820 | 8/1951 | France | 132/149 |
| 1200896 | 12/1959 | France | 132/137 |
| 817024 | 10/1951 | Germany | 132/142 |
| 633291 | 12/1949 | United Kingdom | 132/126 |

*Primary Examiner*—Todd E. Manahan

[57] ABSTRACT

A combination comb, brush, and teaser apparatus includes a first teeth holder which extends along a longitudinal axis. A plurality of first teeth project out from the first teeth holder in a direction perpendicular to the longitudinal axis. A first handle portion is connected to the first teeth holder along the longitudinal axis, and a plurality of second teeth project out from the first handle portion in a direction parallel to the longitudinal axis. The first handle portion includes a concave top side and a concave bottom side. Each of the first teeth tapers down from a teeth holder end to a free end. The free end is rounded. The first teeth are arranged in first teeth rows which are registrable with one another and second teeth rows which are registrable with one another, and wherein teeth in the first teeth rows are staggered with respect to teeth in the second teeth rows. There are two of the first teeth rows and two of the second teeth rows. Each of the second teeth tapers down from a first handle end to a free end. The second teeth are arranged in third teeth rows which are registrable with one another. There are two of the third teeth rows.

3 Claims, 3 Drawing Sheets

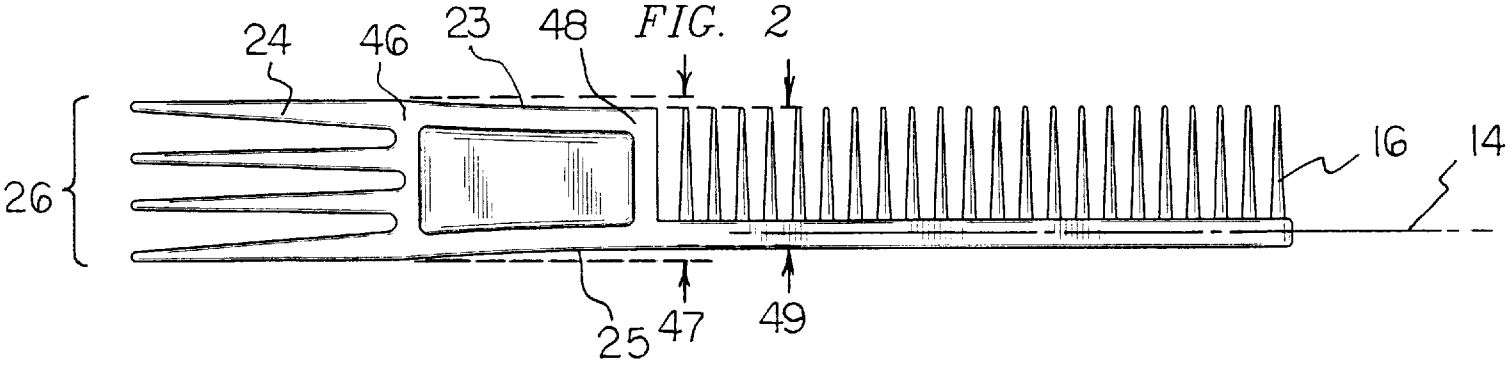
14
16
2
49
FIG.
47
48
25
23
46
24
26
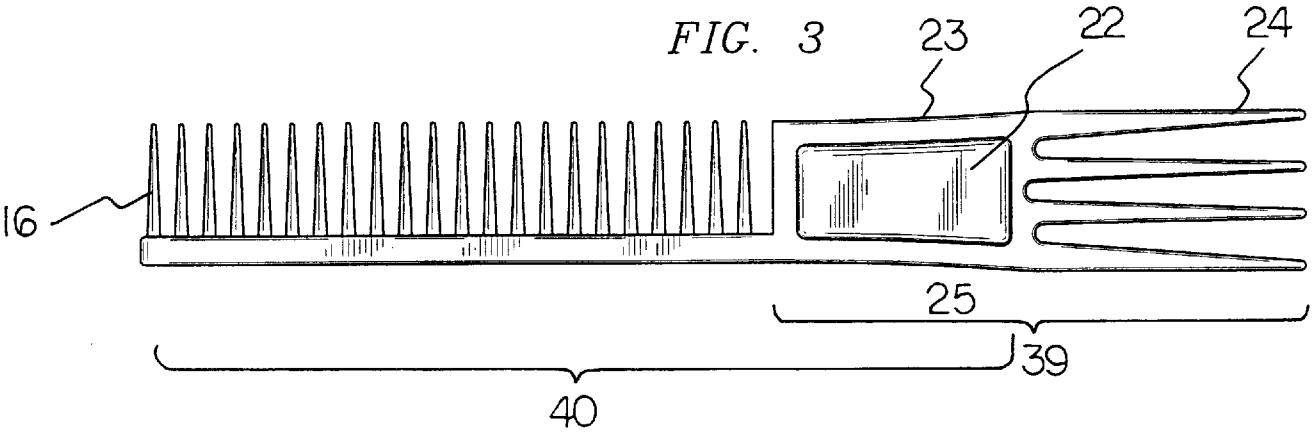
24
22
39
23
25
FIG. 3
40
16

22
24
26

22
16
12

42
44
40
39
20
18
36
24
38

12
24

COMBINATION COMB, BRUSH, AND TEASER APPARATUS

CROSS REFERENCE TO RELATED APPLICATION

This application is a continuation of my prior co-pending patent application Ser. No. 29/063,761, filed Dec. 2, 1996.

BACKGROUND OF THE INVENTION

1. Field of the Invention

The present invention relates generally to hair grooming devices and, more particularly, to hair grooming devices designed to perform one or more of the functions of combing, brushing, or teasing.

2. Description of the Prior Art

In the art of hair grooming, a comb is generally used for combing, a brush is generally used for brushing, and a teaser is generally used for teasing one's hair. Therefore, to perform these three grooming functions, three different devices are needed. It is relatively expensive to purchase three different hair grooming devices. Moreover, it may be cumbersome and consuming of storage space to carry three different hair grooming devices simultaneously. In this respect, it would be desirable if a single combination hair grooming device were provided which can perform all the functions of combing, brushing, and teasing the hair.

Still other features would be desirable in a combination comb, brush, and teaser apparatus. For example, it would be desirable that when the combination device is used as a comb or brush, the device can be easily and comfortably grasped by the user. Also, when the combination device is used as a teaser, it would be desirable if the device can be easily and comfortably grasped by the user.

Sometimes, teeth of a comb have sharp points which can scratch or cut a person's scalp. In this respect, it would be desirable if a combination hair grooming device were provided which has teeth that have dull points so that a person's scalp is not readily scratched or cut.

Even though a combination comb, brush, and teaser apparatus has three functions, it would be desirable if the combination device were made of a unified, one piece construction.

Thus, while the foregoing indicates it to be well known to use combs, brushes, and teasers, the prior art does not teach or suggest a combination comb, brush, and teaser apparatus which has the following combination of desirable features: (1) provides a single combination hair grooming device which can perform all the functions of combing, brushing, and teasing the hair; (2) provides that when the combination device is used as a comb or brush, the device can be easily and comfortably grasped by the user; (3) provides that when the combination device is used as a teaser, the device can be easily and comfortably grasped by the user; (4) has dull points on the teeth so that a person's scalp is not readily scratched or cut; and (5) is made of a unified, one piece construction. The foregoing desired characteristics are provided by the unique combination comb, brush, and teaser apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a combination comb, brush, and teaser apparatus which includes a first teeth holder which extends along a longitudinal axis. A plurality of first teeth project out from the first teeth holder in a direction perpendicular to the longitudinal axis. A first handle portion is connected to the first teeth holder along the longitudinal axis, and a plurality of second teeth project out from the first handle portion in a direction parallel to the longitudinal axis. The first handle portion includes a concave top side and a concave bottom side.

Each of the first teeth tapers down from a teeth holder end to a free end. The free end is rounded. The first teeth are arranged in first teeth rows which are registrable with one another and second teeth rows which are registrable with one another, and wherein teeth in the first teeth rows are staggered with respect to teeth in the second teeth rows. There are two of the first teeth rows and two of the second teeth rows.

Each of the second teeth tapers down from a first handle end to a free end. The second teeth are arranged in third teeth rows which are registrable with one another. There are two of the third teeth rows.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination comb, brush, and teaser apparatus which has all of the advantages of the prior art and none of the disadvantages.

It is another object of the present invention to provide a new and improved combination comb, brush, and teaser apparatus which may be easily and efficiently manufactured and marketed.

It is a further object of the present invention to provide a new and improved combination comb, brush, and teaser apparatus which is of durable and reliable construction.

An even further object of the present invention is to provide a new and improved combination comb, brush, and teaser apparatus which is susceptible of a low cost of manufacture with regard to both materials and labor, and which accordingly is then susceptible of low prices of sale to the consuming public, thereby making such combination comb, brush, and teaser apparatus available to the buying public.

Still yet a further object of the present invention is to provide a new and improved combination comb, brush, and teaser apparatus which provides a single combination hair grooming device which can perform all the functions of combing, brushing, and teasing the hair.

Still another object of the present invention is to provide a new and improved combination comb, brush, and teaser apparatus that provides that when the combination device is used as a comb or brush, the device can be easily and comfortably grasped by the user.

Yet another object of the present invention is to provide a new and improved combination comb, brush, and teaser apparatus which provides that when the combination device is used as a teaser, the device can be easily and comfortably grasped by the user.

Even another object of the present invention is to provide a new and improved combination comb, brush, and teaser apparatus that has dull points on the teeth so that a person's scalp is not readily scratched or cut.

Still a further object of the present invention is to provide a new and improved combination comb, brush, and teaser apparatus which is made of a unified, one piece construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is a first side view of the embodiment of the combination comb, brush, and teaser apparatus shown in FIG. 1.

FIG. 3 is a second side view of the embodiment of the combination comb, brush, and teaser apparatus shown in FIG. 1.

DESCRIPTION OF THE PREFERRED EMBODIMENT

With reference to the drawings, a new and improved combination comb, brush, and teaser apparatus embodying the principles and concepts of the present invention will be described.

Figure 1:
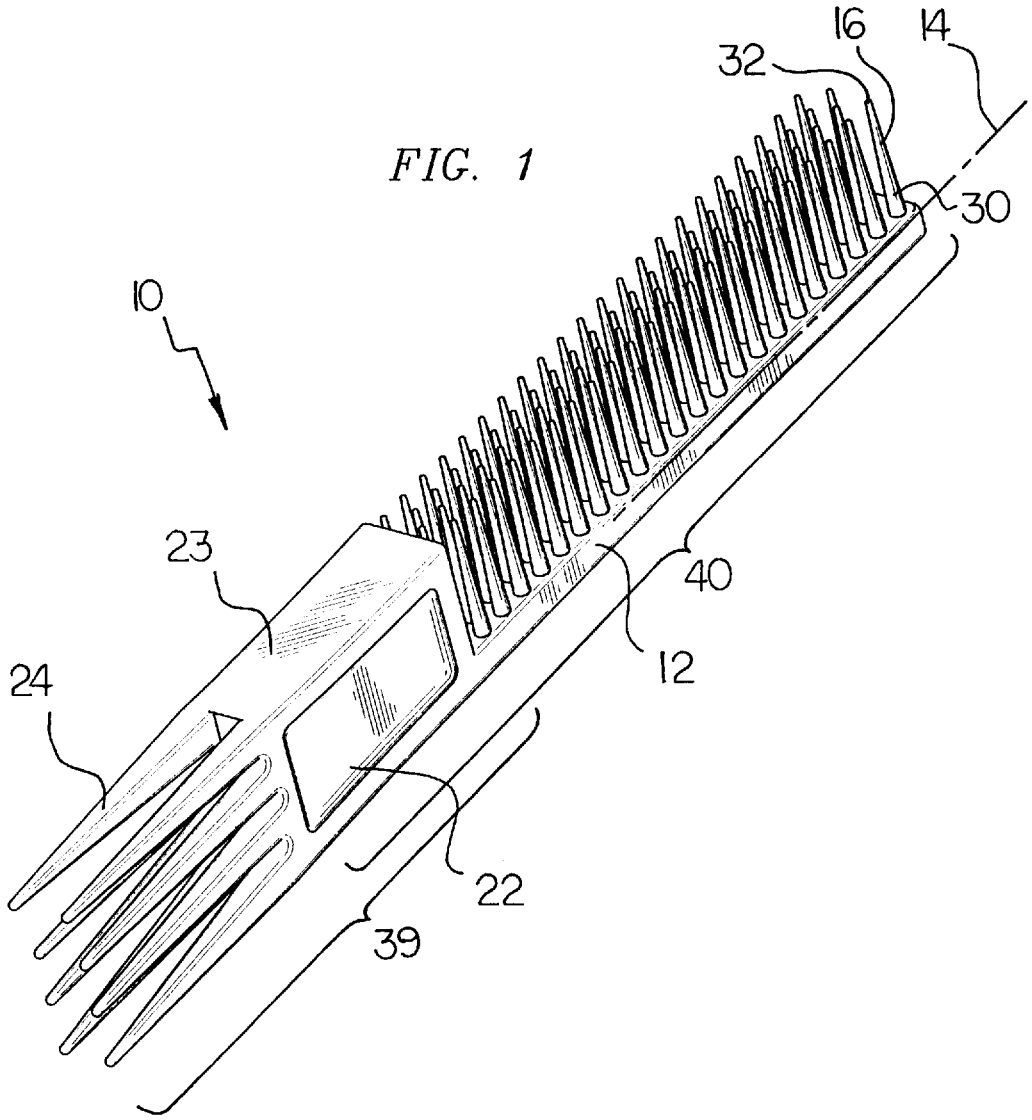
FIG. 1 is a bottom perspective view showing a preferred embodiment of the combination comb, brush, and teaser apparatus of the invention.
Figures 4, 5, 6, 7:
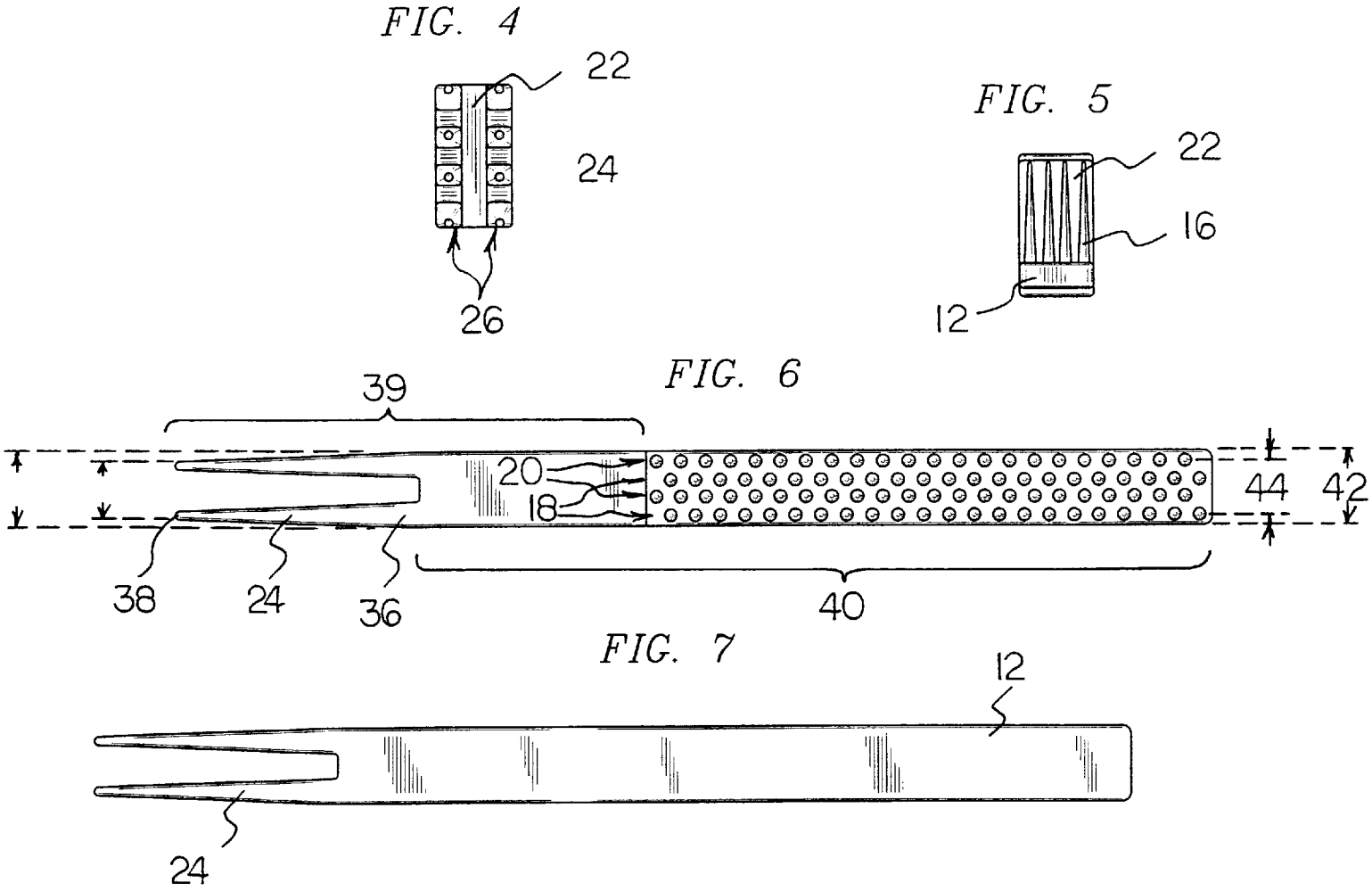
FIG. 4 is a teaser end view of the embodiment of the combination comb, brush, and teaser apparatus of FIG. 1.
FIG. 5 is a comb/brush end view of the embodiment of the combination comb, brush, and teaser apparatus of FIG. 1.
FIG. 6 is a bottom plan view of the embodiment of the invention shown in FIG. 1.
FIG. 7 is a top plan view of the embodiment of the invention shown in FIG. 1.

Turning to FIGS. 1–7, there is shown an exemplary embodiment of the combination comb, brush, and teaser apparatus of the invention generally designated by reference numeral 10. In its preferred form, the combination comb, brush, and teaser apparatus 10 includes a first teeth holder 12 which extends along a longitudinal axis 14. A plurality of first teeth 16 project out from the first teeth holder 12 in a direction perpendicular to the longitudinal axis 14. A first handle portion 22 is connected to the first teeth holder 12 along the longitudinal axis 14, and a plurality of second teeth 24 project out from the first handle portion 22 in a direction parallel to the longitudinal axis 14.

Each of the first teeth 16 tapers down from a teeth holder end 30 to a free end 32. The free end 32 is rounded. The first teeth 16 are arranged in first teeth rows 18 which are registrable with one another and second teeth rows 20 which are registrable with one another, and wherein teeth in the first teeth rows 18 are staggered with respect to teeth in the second teeth rows 20. There are two of the first teeth rows 18 and two of the second teeth rows 20.

Each of the second teeth 24 tapers down from a first handle end 36 to a free end 38. The second teeth 24 are arranged in third teeth rows 26 which are registrable with one another. There are two of the third teeth rows 26.

The first handle portion 22 includes a concave top side 23 and a concave bottom side 25. The concave top side 23 and the concave bottom side 25 facilitate the use of the first handle portion 22 when grasped. The combination comb, brush, and teaser apparatus 10 can be of a unified, one piece construction of a suitable plastic or rubber. Preferably, the plastic or rubber has a desirable amount of flexbility and resiliency.

The combination comb, brush, and teaser apparatus 10 can be used in a number of ways. To use the combination comb, brush, and teaser apparatus 10 as a comb or brush, a user grasps the first handle portion 22 and the third teeth rows 26. Both the first handle portion 22 and the third teeth rows 26 serve as a first overall handle 39 for the first teeth 16 used as a comb or brush.

To use the combination comb, brush, and teaser apparatus 10 as a teaser or pick, a user can grasp either the first teeth holder 12 and the first teeth 16 together, and the first teeth holder 12 and the first teeth 16 together form a combined handle for the second teeth 24 that are used for teasing or picking the hair. In addition, to use the combination comb, brush, and teaser apparatus 10 as a teaser or a pick, a user's hand can also grasp a portion of first handle portion 22. In this respect, the first handle portion 22, the first teeth holder 12, and the first teeth 16 can serve as a second overall handle 40 for the second teeth 24 used as teaser or a pick.

It is noted that the tapering of the first teeth 16 and the tapering of the second teeth 24 have a surprising and beneficial effect. That is, the tapering permits the first overall handle 39 and the second overall handle 40 to be grasped comfortably by the user. More specifically, a teeth holder width 42 of the first teeth holder 12 is greater than a transverse tip to tip width 44 between the most separated rows of teeth projecting from the first teeth holder 12.

In addition, the first handle portion 22 has a large height end 46 connected to the second teeth 24 and a small height end 48 connected to the first teeth holder 12. The large height end 46 has a large height 47, and the small height end 48 has a small height 49. In this respect, the large height end 46 tapers to the small height end 48 and provides a comfortable first handle portion 22 for grasping when the first handle portion 22 and the second teeth 24 are used as a handle for the apparatus when used as a comb or brush. The combination comb, brush, and teaser apparatus 10 can be used to comb, brush, tease, fluff, and puff the hair of the user.

The components of the combination comb, brush, and teaser apparatus of the invention can be made from inexpensive and durable plastic or rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved combination comb, brush, and teaser apparatus that is low in cost, relatively simple in design and operation, and which may advantageously be used to provide a single combination hair grooming device which can perform all the functions of combing, brushing, and teasing the hair. With the invention, a combination comb, brush, and teaser apparatus provides that when the combination device is used as a comb or brush, the device can be easily and comfortably grasped by the user. With the invention, a combination comb, brush, and teaser apparatus provides that when the combination device is used as a teaser, the device can be easily and comfortably grasped by the user. With the invention, a combination comb, brush, and teaser apparatus is provided which has dull points on the teeth so that a person's scalp is not readily scratched or cut. With the invention, a combination comb, brush, and teaser apparatus is provided which is made of a unified, one piece construction.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A combination comb, brush, and teaser apparatus comprising:

a first teeth holder which extends along a longitudinal axis;

a plurality of first teeth projecting out from said first teeth holder in a direction perpendicular to said longitudinal axis;

a first handle portion connected to said first teeth holder along said longitudinal axis;

a plurality of second teeth projecting out from said first handle portion in a direction parallel to said longitudinal axis, the second teeth being arranged in third teeth rows, each third teeth row containing a plurality of the second teeth registered with one another, there being a total of two of said third teeth rows, with a first one of the third teeth rows being positioned in a spaced and parallel orientation with respect to a second one of the third teeth rows such that a quantity of hair can be captured between and supported by the first one of the third teeth rows and the second one of the third teeth rows; and wherein said first handle portion between said first plurality of teeth and said second plurality of teeth includes a concave first side and a concave second opposed side.

2. The apparatus of claim 1, wherein:

said first teeth are arranged in first teeth rows which are registrable with one another and second teeth rows which are registrable with one another, and wherein teeth in said first teeth rows are staggered with respect to teeth in said second teeth rows.

3. The apparatus of claim 2, wherein there are two of said first teeth rows and two of said second teeth rows.

* * * * *